US009756968B1

(12) United States Patent
Gewant

(10) Patent No.: US 9,756,968 B1
(45) Date of Patent: Sep. 12, 2017

(54) HEAD-NECK POSTURE DEVICE

(71) Applicant: Tec-Human Integration Solutions LLC, Jupiter, FL (US)

(72) Inventor: Robert Gewant, Jupiter, FL (US)

(73) Assignee: Tec-Human Integration Solutions LLC, Jupiter, FL (US)

( * ) Notice: Subject to any disclaimer, the term of this patent is extended or adjusted under 35 U.S.C. 154(b) by 57 days.

(21) Appl. No.: 15/359,297

(22) Filed: Nov. 22, 2016

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC ..... A47G 9/1081; A47G 2009/1018; A47G 9/10; A47G 9/1027; A47G 9/1072; A47G 9/109; A61G 13/121; A61G 7/072; A61H 15/00; A61H 2015/0007; A61H 2015/0014; A61H 2015/0042; A61H 2015/005; A61H 2015/0064; A61H 39/04; A61H 2201/1284; B60N 2/646
See application file for complete search history.

(56) References Cited

U.S. PATENT DOCUMENTS 4,210,134 A * 7/1980 Okazaki ..... A61H 39/04 5/421
5,263,474 A * 11/1993 Agader ..... A61H 15/00 601/113
5,481,771 A * 1/1996 Burk, IV ..... A47G 9/10 5/490
5,820,573 A * 10/1998 Ramos ..... A61H 7/001 5/632
5,911,656 A * 6/1999 Futagami ..... A61H 39/04 5/636
5,913,839 A * 6/1999 Wincek ..... A61H 7/001 601/115
6,305,040 B1 * 10/2001 Myler ..... A61H 39/04 5/630
6,345,401 B1 * 2/2002 Frydman ..... A47G 9/10 5/636
6,921,372 B2 * 7/2005 Shin ..... A61F 5/01 5/630
7,811,241 B1 * 10/2010 Baker ..... A61H 1/0296 601/131
D649,653 S * 11/2011 Halvorsen ..... D24/215
2004/0172762 A1 * 9/2004 Lenyo ..... A47G 9/10 5/655
2006/0048300 A1 * 3/2006 DiGirolamo ..... A47G 9/10 5/645
2012/0005911 A1 * 1/2012 MacFarlane ..... A47G 9/0253 33/512
2012/0117702 A1 * 5/2012 King ..... A41B 17/005 2/2.16
2015/0305966 A1 * 10/2015 George ..... A61H 15/0085 601/131
2016/0278553 A1 * 9/2016 Biebl ..... A47G 9/1081

* cited by examiner

*Primary Examiner* — Eric Kurilla
(74) *Attorney, Agent, or Firm* — McHale & Slavin, P.A.

(57) ABSTRACT

A head-neck posture restoration/correction, strengthening device formed from a portable pad having a shape retaining inner core including highly compressed rubber spheres. The inner core top surface has multiple protrusions and is covered by a thin outer shell coating. The shape of the top surface provides a designated neck and head placement area, allowing the user's neck to curve around the designated neck area while translating the weight of the user's head to compress into the semi-resistant designated head area.

6 Claims, 6 Drawing Sheets

HEAD-NECK POSTURE DEVICE

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

FIELD OF THE INVENTION

This invention is directed to the field of posture correction and, in particular, to a Head-Neck Posture Restoration/Correction and Strengthening Device.

BACKGROUND OF THE INVENTION

The human spine comprises several regions; each region has a direct role to obtain good posture and health. The cervical spinal region corresponds to the neck and allows for a neck-head alignment and natural curve that is important in contributing to properly supporting the weight of the head, a healthy posture and proper biomechanics of head, neck and spinal movements.

In a normal erect spine, the head should be suspended directly over the spine. This keeps the weight of the head over the body's center of gravity. The head is suspended, not by an inflexible pole, but rather by a curve formed by the 7 vertebral bones in the neck. This normal head/spine position and neck curve acts as a shock absorber for the head with each ambulatory movement. The curve is bio-structurally correct when viewed from the side of the head/neck/spine and the cervical curve appears as a wide backward "C", orientated towards the back of the neck. When the neck/cervical spine has the natural, normal good posture, the normal position of the neck/head provides for the weight of the head (8-12 pounds) to be carried without any structural or physical problems. This is called normal head posture (carriage) and normal cervical neck curve posture.

Anterior (forward) positioning of the head and spine with resulting loss of the normal cervical curve is caused by many factors including, but not limited to, the following activities of daily living: looking down while typing or reading, sitting improperly with shoulders rounded and back hunched, driving with your head more than 2 to 3 inches away from the headrest, carrying a backpack or heavy purse slung over one shoulder, watching TV/movie with your head forward, sleeping with your head elevated too high, lack of developed back muscle strength and the extensive use of hand held technology (smart phones, smart tablets and laptop computers). The resulting abnormal posture is demonstrated in the head shifting forward from a neutral position, with the resulting loss of the natural cervical curve. It should be noted that, for every 1 inch the head posture is carried forward of the center of gravity, the head effectively weighs approximately 8-12 more pounds. With a measurable 4 inches of forward head posture, the weight of the head on the spine is equivalent to 32-48 pounds.

Numerous factors including those listed above result in measurable distortions to the normal head position and the normal curve of the neck/cervical spine. This abnormal positioning is commonly referred to as forward head movement, or "Forward Head Posture (Carriage)". When the head shifts forward of the body's center of gravity, the spinal column in the neck elongates and the normal cervical curve straightens, "Straight Neck Posture". This Forward Head Posture with Straight Neck Posture are both considered abnormal Postural Deviations that, with the recent introduction of the hand held technology devices, are now being observed in explosive numbers worldwide. Physiologically, you have Healthy Normal Posture and Good Alignment when your head, neck and ear line up exactly with the Gravity Line. The Gravity Line (Plumb Line) is an imaginary straight line representing the downward pull of gravity and is used in posture analysis as a reference for documenting the positions of body parts and determining the presence of any postural misalignment or deviation. A forward head posture "Forward Head Carriage/Posture with Straight Neck Posture" occurs when the head is positioned forward of this gravity line, when looking at the body from the side and, for this reason, is considered an abnormal deviation.

Considering the mechanism from a clinical perspective: In regard to the numerous listed and not listed daily activities, as well as the prolonged/extended use of hand held technology devices such as cell phones and tablets, as well as laptops and computers, abnormal posture cumulatively increases neck flexion (flexion means bending forward). Usually, the lower part of the neck (called the cervical spine, or "c-spine" for short) is the area that flexes most, and the upper c-spine extends (bends backward) as the head is lifted, providing for sight.

Forward Head Posture with Straight Neck Posture and Muscle Group Imbalance are often noted together. The presence of this poor, unhealthy posture often results in a strength imbalance between muscles that support and move the neck, shoulders and head; and is demonstrated in the muscles in front of the neck becoming weak, while the ones in the back of the neck become short, tight and strained.

Forward Head Posture (Carriage) and Straight Neck Posture can ultimately result in abnormal head/neck position, structure and or function, and is associated with numerous negative health related disorders and conditions including, but not limited to, chronic pain in the neck, shoulders or upper, lower, and middle back, referred pain into the hands, and permanent damage to joints, muscles, ligaments, blood vessels and nerves. In addition, the resulting tension on the spinal cord and carotid arteries as they ascend into the brain to feed it oxygen and nutrients can cause dizziness, headaches, nausea, fatigue, tinnitus, pain, nervousness, insomnia, high blood pressure, and confusion. Therefore, restoring normal, good, healthy posture by correcting or reducing Forward Head Posture and Straight Neck Posture is of paramount importance, and the reason for an urgent need for this device that helps accomplish this.

Currently, separate head-neck posture restoration/correcting items as well as neck strengthening items are available. The existing head-neck posture restoration/correcting items are found to be available separate from the neck strengthening items. Most head-neck posture restoration/correcting items are stationary brace-like items, and most neck strengthening items offered are mechanical with moving parts. Other separate head-neck posture restoring/correcting and neck strengthening devices are difficult to transport. Thus, there is a clear and imperative need for a head-neck posture restoration/correction device and a neck strengthening device that is combined into one device, without mechanical movable parts, which is comfortable and convenient to use, and easy to transport.

None of the head-neck posture restoration/correction items and or separate neck strengthening items are combined into one comfortable device that can be used by all ages (from child to senior), can be transported easily, can be used standing/sitting/laying down, and provide a one-size-fits-all solution. For example, existing head-neck posture restoration/correction items and or separate neck strengthening items require adjustments to take into account the size and age of the user. Thus, there is a need for a non-adjustable, one-size-fits-all head-neck posture restoration/correction, strengthening device combined as one device.

Further, none of the head-neck posture restoration/correction items and or separate neck strengthening items available can be easily packable. Such a concern is especially relevant to the many people that use such a device while traveling. The head-neck posture restoration/correction items are usually rigid and resist compression, and the separate mechanical devices with moving parts are bulky, heavy and non-compressible.

There is no known device that combines both a head-neck posture restoration/correction device and separate neck strengthening device, regardless of the above-described problems. Thus, there is a need for a single device that combines both separate devices into one head-neck posture restoration/correction, strengthening device.

The above problems, and others, are reduced by the invention as herein described and shown.

SUMMARY OF THE INVENTION

This invention provides a head-neck posture restoration/correction device and a neck-strengthening device within a single apparatus. According to an exemplary embodiment, the head-neck posture restoration/correction and strengthening device comprises a flat based, portable pad device having a shape retaining inner core formed of compressible semi-resistant material with a single layer of highly compressed, greater resistant, rubber spheres. The inner core has a top surface with protrusions made of the same or similar compressible, semi resistant, shape retaining material and is covered by a soft thin outer shell coating. The shape of the device provides a designated neck and head placement area, allowing the back of the user's neck to curve around the designated neck area while translating the weight of the back of the user's head to compress into the semi-resistant designated head area.

An objective of the invention is to provide a device for head-neck posture restoration/correction, and strengthening required as a result of the negative effects from various activities of daily living.

Another objective of the invention is to teach the use of a compressible material along an inner, upper and lower core of the device that allows the user to compress the device with manual power alone, yet retains the shape once the pressure of the user's head and neck are removed.

Yet still another objective of the invention is to disclose a device that, upon the long-term repetitive motion of the user extending and retracting their head-neck against the semi-resistance/resistance of the device, provides strengthening of the neck extension muscles and restoration/correction of the normal forward neck/spinal cervical curve.

Still another objective of the invention is to teach the use of soft-top surface protrusions that provide a feeling of multiple pressure point relief and stimulation to the areas of the back of the head and the back of the neck that make contact with the semi-resistant protrusions.

Yet still another objective of the invention is to disclose a device that a user may use standing, sitting or in a lying position.

Another objective of the invention is to teach the use of a support portion that can be compressed by backward (extended/retraction) movement of the user's head, first against the semi-resistant inner core material, continuing into the single layer of highly resistant seventy rubber spheres and finally against the resistance of the supporting wall/floor, in order to generate resistance to strengthen the extension and supporting muscles of the neck.

Still another objective of the invention is to teach the use of top surface semi-resistant protrusions (finger-like) to contact areas of the head/neck to provide acupressure-like point relief and stimulation.

Still another objective of the invention is to teach the use of a head-neck posture addressing device having a flat base with slip resistant coating allowing device stability.

Other devices, methods, and/or products according to the following embodiments will be or will become apparent to one of ordinary skill in the art upon review of the following drawings and further description. It is intended that all such additional devices, methods, and/or products be included within this description, be within the scope of the present invention, and be protected by the accompanying claims.

DETAILED DESCRIPTION

Figure 1:
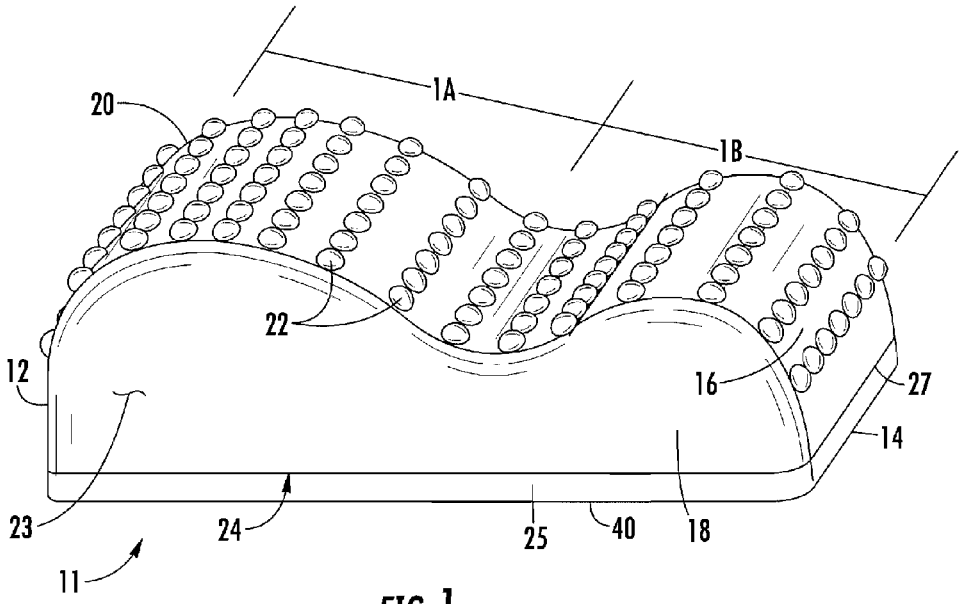
FIG. 1 is a perspective view of the head-neck posture device.
Figure 2:
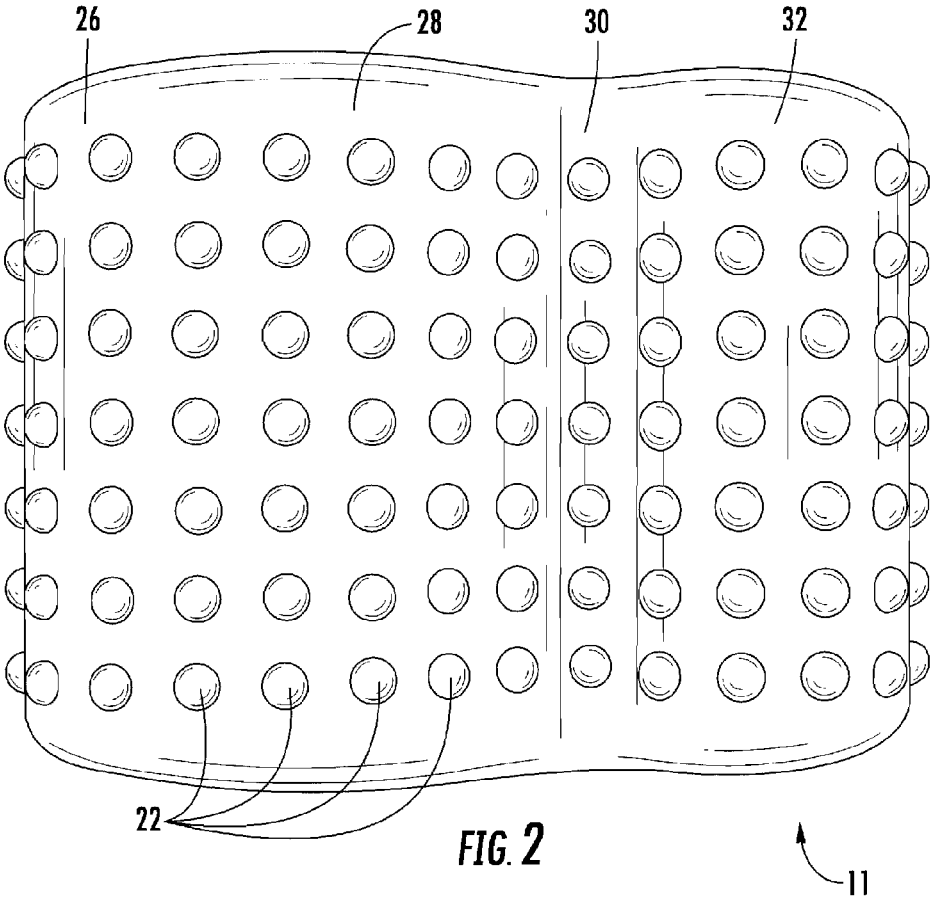
FIG. 2 is a top view of the head-neck posture device.
Figure 3:
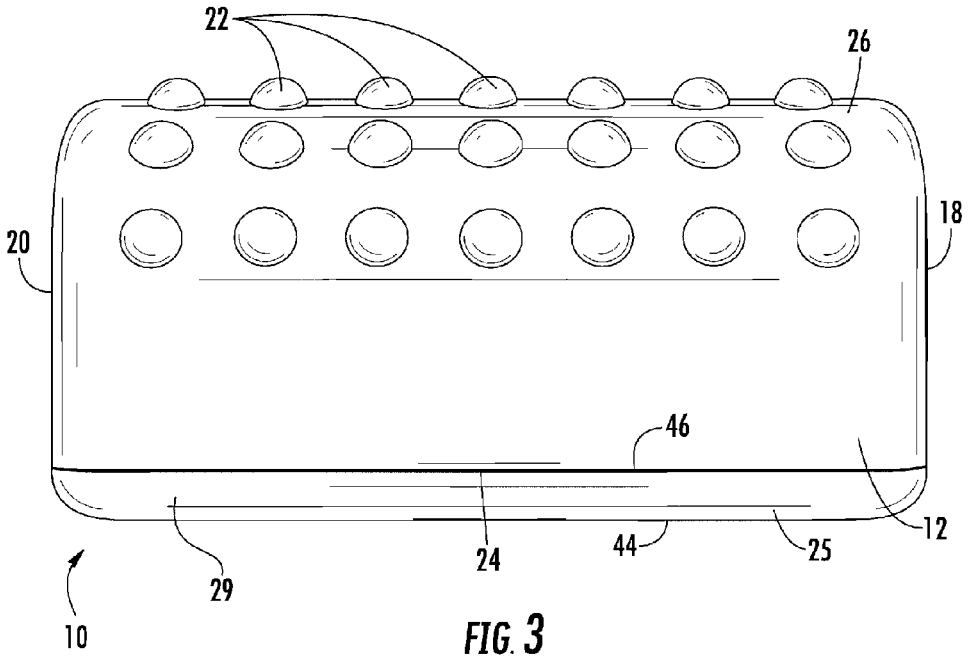
FIG. 3 is an end view of the head portion of the head-neck posture device.
Figure 4:
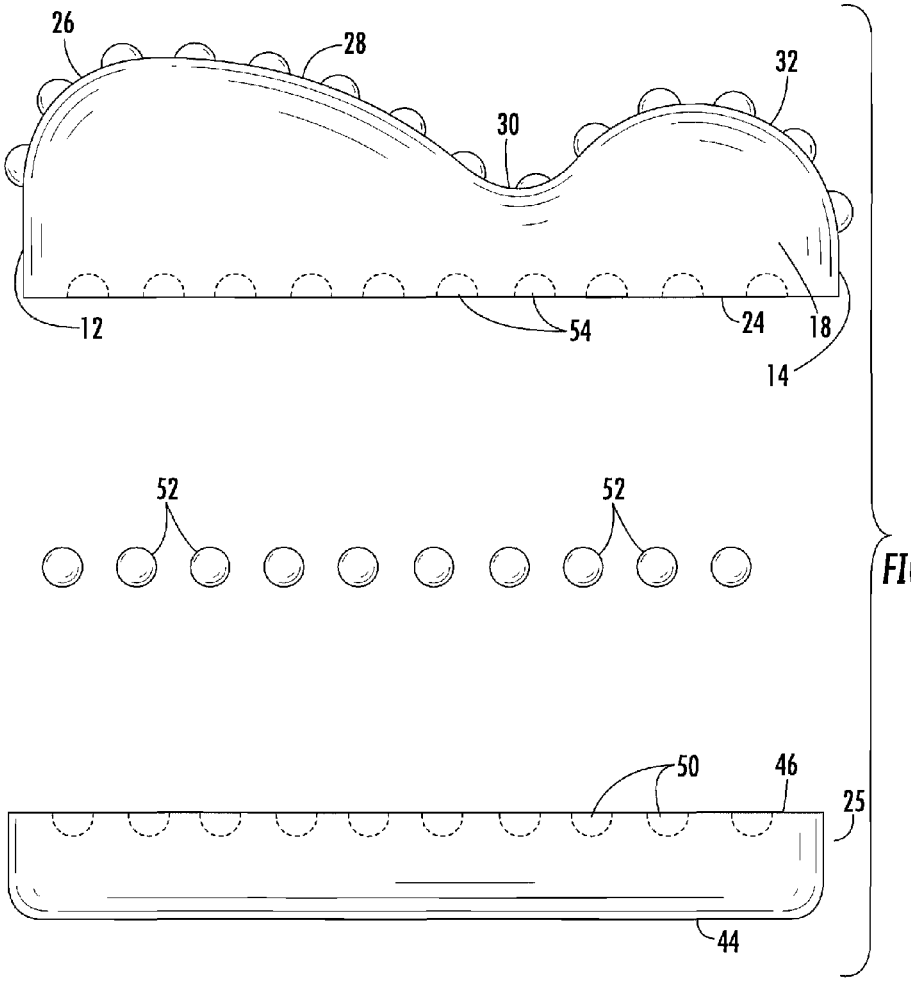
FIG. 4 is an exploded side view.
Figure 5:
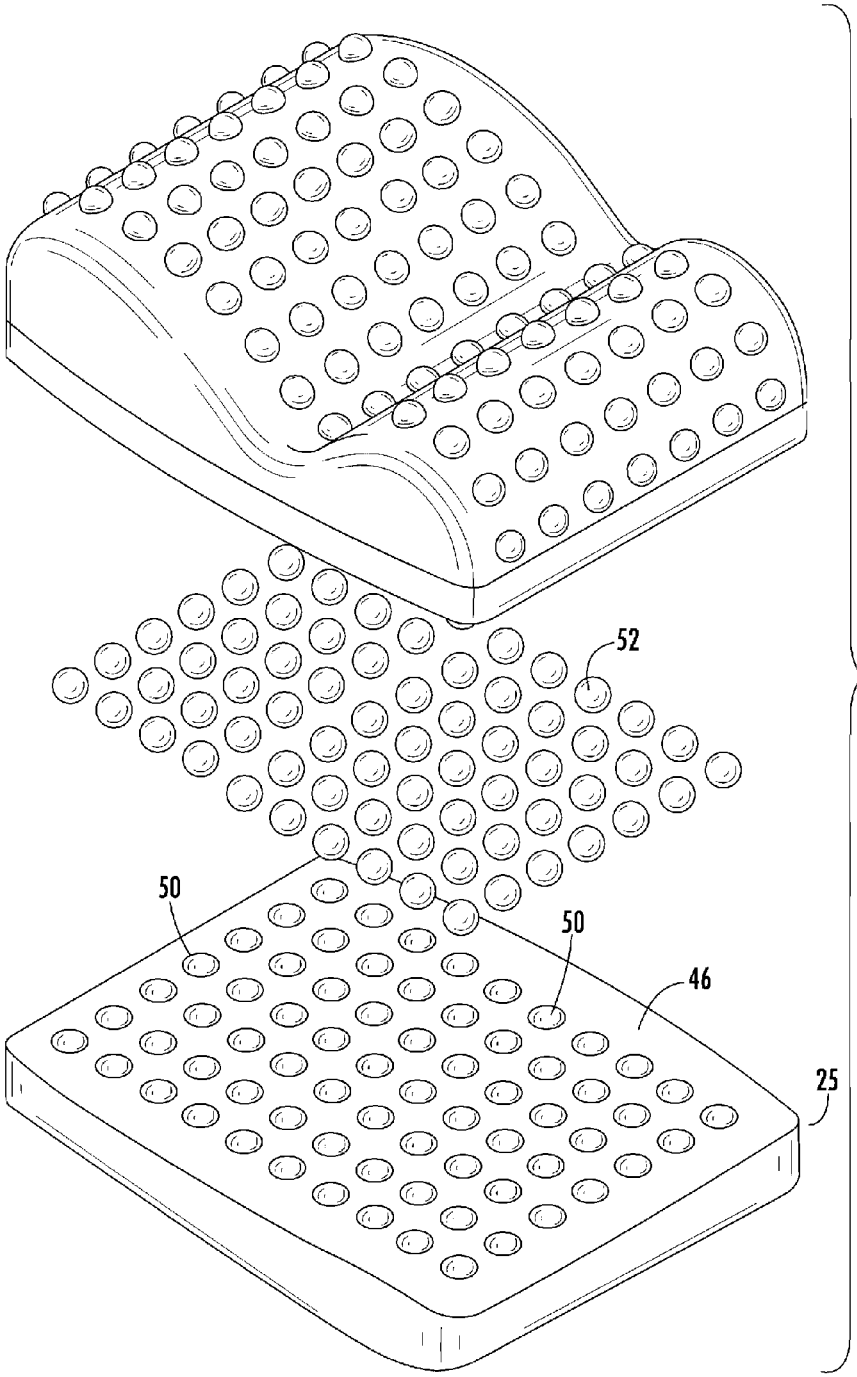
FIG. 5 is an exploded perspective view.
Figure 6:
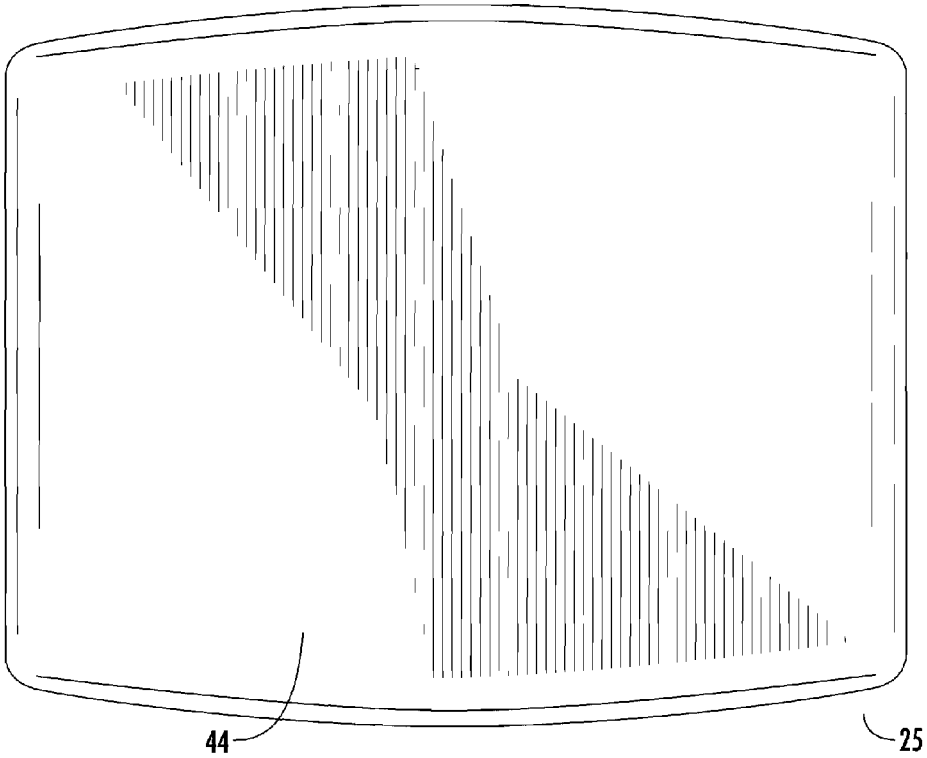
FIG. 6 is a bottom view.

A detailed embodiment of the instant invention is disclosed herein; however, it is to be understood that the disclosed embodiment is merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring to the figures, the head-neck posture restoration/correction, strengthening device 10 is defined by an upper core 11 having first end wall 12, a second end wall 14 with an upper surface 16 formed therebetween; the upper surface 16 having a plurality of protrusions 22 that are equally spaced between a left side wall 18 and a right side wall 20. In the preferred embodiment, there is about seven protrusions equally spaced between the side wall 18, 20 and about 14 rows of protrusions 22 equally spaced from the first end wall 12 to the second end wall 14 along the upper surface 16. The upper core 23 is secured to a lower core 25.

The device is further defined by a head portion 1-A, and a neck portion 1-B. The upper surface 16 of the head portion 1-A is formed from the first end wall 12, having a 90 degree bend portion 26 leading to a gradual curve portion 28. A transition portion 30 provides an upward coupling to an inverted U-shaped section 32 that extends from the transition portion 30 to the second end wall 14. The upper surface texture is smooth with multiple protrusions 22 formed from an inner core 23 of foam rubber and covered with a soft thin outer shell coating 27. The length of the device 10, in the preferred embodiment, is about 11 inches from the first end wall 12 to the second end wall 14. The width of the device is about 8.8 inches extending from the left side wall 18 to the right side wall 20.

The height of the head portion 1-A, measured from the lower surface 40 of bottom portion 25 to the upper surface 16 of the head portion 1-A is about 4.6 inches, and the height of the neck portion, measured from the lower surface 40 of bottom portion 25 to the upper surface 16 of neck portion 1-B is about 4.0 inches.

The lower section 25 has a substantially flat bottom 44 with an outer surface 29, preferably of a non-marring material that is slip resistant. The thickness of the lower section 25, measured from the bottom 44 to a top surface 46, is about 1.4 inches. The top surface 46 includes a plurality of pockets 50 that are constructed and arranged to receive ½ of a spherical ball 52, the top surface 46 forming an egg crate type receptacle to preferably position seventy (70) spheres 52 in equally spaced apart positions; illustrated are ten rows with seven spheres per row. The lower surface 24 includes reciprocal pockets 54 for receipt of ½ of the spherical ball 52. The spheres 52 are spheres made from solid, highly compressed rubber material, such as, for example, a synthetic polymer polybutadiene, as well as hydrated silica, zinc oxide, stearic acid and other ingredients. This compound is vulcanized with sulfur at a temperature of 165 degrees Celsius and formed at a pressure of 3,500 psi. The resulting ball has a very high coefficient of restitution that stores energy when compressed and returns the energy when released from any compression. The spheres are captured within the pockets, and the top surface 46 permanently attached to the lower surface 24 using a spray adhesive.

The foam rubber that forms the inner core 23 consists of a soft, lightweight, shape retaining, solid foam, spongy cellular material, such as, for example, a polyester or polyurethane resin. After assembly, the upper core 18 and the lower core 25 are spray painted such as, for example, with colored liquid polyurethane.

The head-neck posture restoration/correction, strengthening device 10 provides a designated head portion 1-A and neck portion 1-B placement area, allowing the user's neck to curve around the designated neck portion 1-B while translating the weight of the user's head to compress into the semi-resistant designated head portion 1-A. The long-term repetitive motion of the user extending/retracting their head-neck against the resistance of the device provides strengthening of the neck extension muscles and restoration/correction of the normal forward neck-spinal cervical curve. The soft semi-resistant, shape retaining, top surface protrusions provide acupressure point relief and stimulation to the areas of the head and neck they make contact with.

This head-neck posture restoration/correction, strengthening device 10 comprises an outer coating sheath 27 covering the flexible and compressible, semi resistant, shape retaining inner core with an interior layer of highly compressed, resistant, rubber spheres 52. The head portion 1-A of the device can be compressed by backward (extended/retraction) movement of the user's head against the resistance of inner core material the inner layer of rubber spheres and against the resistance of the wall/floor, in order to generate resistances to strengthen the extension and support muscles of the neck. The neck portion 1-B of the device pushes outward with semi resistance against the back of the neck as the back of the head moves backward (extending/retracting), resulting in the restoring/correcting of the natural forward curve of the neck (cervical spine). The multiple top surface protrusions 22 (finger-like) are composed of the same inner core, compressible, semi resistant, shape retaining material, and provide acupressure point relief and stimulation to the contacted areas of the head/neck. The device's flat base 44 with slip resistant coating 29 provides stability to the device when up against the wall (sitting or standing) or on a floor surface. The weight of the user's head translates pressure through the device to the bottom base, stabilizing the device against the contact surface during use. It is preferable for maximum desired results, that the device is used up against a wall when the user is standing or in a seated posture position. The device can be used with the user lying down on their back.

The device comprises two distinct areas: a back of head portion and aback of neck portion. The head portion 1-A of the device can be compressed against its semi resistance by numerous exercises/movements including the following two specific movements/exercises. The first movement/exercise is a repetitive backward (extended) movement of the back of user's head against the semi resistance of the inner core material of the device that includes an inner layer of highly compressed rubber spheres 52, in order to generate resistance to strengthen the extension muscles of the neck. The second movement/exercise is a repetitive chin arc (retraction) movement of nodding the head slowly forward without moving the neck and the resulting simultaneous movement of the back of user's head against the semi resistance of the inner core material of the device that includes an inner layer of highly compressed rubber spheres, in order to generate resistance to strengthen the extension muscles of the neck. In both the first and second movements/exercises, the neck portion 1-B of the device pushes outward with semi resistance against the back of the user's neck as the head moves backward (extending/retracting), resulting in the restoring/correction of the natural forward curve of the neck (cervical spine). The multiple top surface protrusions 22 provide pressure point relief and stimulation to the contacted areas of the head and neck. The device's flat base 44 with slip resistant coating 29 provides device stability when used? up against the wall (sitting or standing) or on a floor surface. The weight of the user's head translates pressure through the device to the bottom base, stabilizing the device during use.

It is preferable, for maximum desired results, that the device is used up against a wall when the user is standing or in a seated position. The device can be used, with less desired results, with the user lying down on their back.

Three phases of penetration resistance of the users head into the device are as follows: first level of resistance against the semi-resistant inner core material; second level of resistance is the continuing movement of the users head into the single layer of seventy highly resistant rubber spheres; third level of resistance is the continuing movement of the users head against the resistance of the supporting wall or floor.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A device to restore and/or correct a natural forward posture and/or curve of a neck and/or cervical spine and to strengthen head and/or neck extension muscles, the device comprising:

an upper core defined by an upper surface having a plurality of protrusions, a lower surface, first and second ends with a transition portion therebetween, and opposing side walls; said upper surface forming a head portion having a first height formed from a first contour beginning with said first end to said transition portion and a neck portion having a second height formed from a second contour beginning with said second end to said transition portion, wherein said first height is greater than said second height;

a plurality of rubber spheres positioned along said lower surface of said upper core;

a lower core secured to said upper core securing said plurality of rubber spheres therebetween, said lower core further defined by a top surface secured to the lower surface of said upper core, a substantially flat bottom surface, first and second edges, and opposing side panels;

wherein said upper core includes pockets to receive a portion of said spheres and said lower core includes reciprocal pockets to receive a remaining portion of said spheres; and an outer sheath comprising a slip-resistant material encapsulating said upper and lower core;

wherein said head portion is configured to restore and/or correct the natural curve of an individual's neck and cervical spine, with said protrusions constructed and arranged to relieve pressure points and stimulate areas of contact when a user engages the head portion, and said spheres generate a resistance to compression from the user's head and neck to strengthen the extension muscles of the neck.

2. The device of claim 1, wherein said inner core comprises a cellular material.

3. The device of claim 2, wherein said cellular material is a type of polyester resin.

4. The device of claim 1, wherein said upper core is secured to said lower core with adhesive.

5. The device of claim 1, wherein said spheres are made of a vulcanized synthetic polymer polybutadiene compound.

6. The device of claim 1, wherein said outer sheath material is composed of a spray-on liquid polyurethane paint.

* * * * *